US005701795A

United States Patent [19]

Friedrichsen

[11] Patent Number: 5,701,795

[45] Date of Patent: Dec. 30, 1997

[54] HYDRAULIC SYSTEM

[75] Inventor: Welm Friedrichsen, Nordborg, Denmark

[73] Assignee: Danfoss A/S, Nordborg, Denmark

[21] Appl. No.: 464,688

[22] PCT Filed: Nov. 30, 1993

[86] PCT No.: PCT/DK93/00390

§ 371 Date: Jun. 6, 1995

§ 102(e) Date: Jun. 6, 1995

[87] PCT Pub. No.: WO94/13958

PCT Pub. Date: Jun. 23, 1994

[30] Foreign Application Priority Data

Dec. 11, 1992 [DE] Germany ..... 42 41 846.1

[51] Int. Cl.[6] ..... F15B 11/08

[52] U.S. Cl. ..... 91/446; 91/448

[58] Field of Search ..... 91/449, 446, 447, 91/448, 433, 509, 510

[56] References Cited

U.S. PATENT DOCUMENTS

| | | | |
|---|---|---|---|
| 4,066,004 | 1/1978 | Alcalay | 91/447 X |
| 5,000,001 | 3/1991 | Christensen et al. | 91/446 X |
| 5,083,430 | 1/1992 | Hirata et al. | 91/448 X |
| 5,207,059 | 5/1993 | Schexnayder | 91/448 X |

FOREIGN PATENT DOCUMENTS

| | | | |
|---|---|---|---|
| 2233167 | 1/1974 | Germany | 91/509 |
| 0580368 | 11/1977 | Russian Federation | 91/446 |
| 1222104 | 2/1971 | United Kingdom | 91/509 |

*Primary Examiner*—Hoang Nguyen
*Attorney, Agent, or Firm*—Lee, Mann, Smith, McWilliams, Sweeney & Ohlson

[57] ABSTRACT

A hydraulic system is proposed, with a pressure source (P), a pressure sink (T), a work motor (4), a main valve (3) which is arranged between the pressure source (P) and the pressure sink (T) on the one hand and the work motor (4) on the other hand and is connected to the work motor (4) by way of work connections (73, 74), and a compensating valve (2) between the pressure source (P) and main valve (3) and an additional valve arrangement (5) between the main valve (3) and the pressure sink (T), which controls the volume flow from the main valve to the pressure sink (T). In a system of that kind it is desirable to provide better control facilities. To that end, the valve arrangement (5) has an externally controllable degree of opening.

30 Claims, 8 Drawing Sheets

Figure 1:
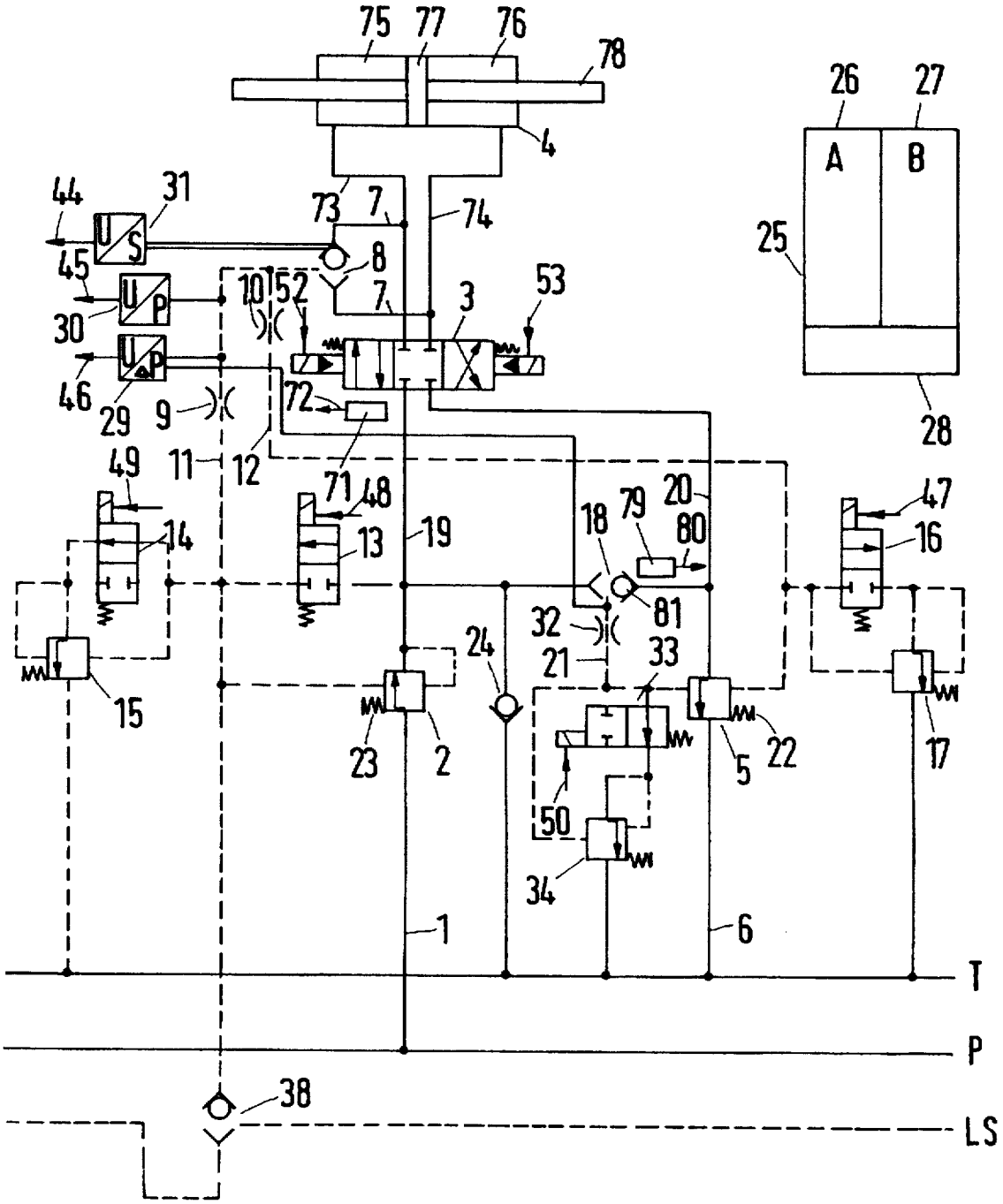

102
26
I
91
100
94
28
95
101
98
27
II
92
99
103
83
104
105
96
93
97
I
II
T
P
38
38
LS
Y
Y

HYDRAULIC SYSTEM

The invention relates to a hydraulic system with a pressure source, a pressure sink, a work motor, a main valve which is arranged between the pressure source and the pressure sink on the one hand and the work motor on the other hand and is connected to the work motor by way of work connections, a compensating valve, namely, an input compensating valve, between the pressure source and main valve, and an additional valve arrangement between the main valve and the pressure sink, which controls the volume flow from the main valve to the pressure sink.

In the following description, for the sake of simplicity the pressure source is called a pump and the pressure sink is called a tank.

A system of that kind is known from EP 362 409 B1.

In another known system (DE 34 36 246 C2), the compensating valve controls the volume flow of hydraulic fluid through the main valve in dependence on the pressures in the input connection of the main valve, in the tank connection of the main valve and in the work connection of the main valve, which is connected to the single work chamber illustrated here of the work motor. Hydraulic fluid flowing out of the work motor flows through the main valve back to the tank.

In another hydraulic system (WO 90/12165), the compensating valve is controlled by the higher of the two pressures in the work connections. The main valve here additionally assumes the function of directional control. Hydraulic fluid flowing back from the work motor flows through the main valve directly to the tank.

WO 88/05135 describes a control arrangement for hydraulic cylinders that is manually operable. The control arrangement described in this publication corresponds to the main valve of the two above-described systems. This main valve is constructed so that the volume flow through the valve is automatically reduced whenever the work pressure across the valve approaches its maximum. This in an advantage in particular in the connection with cranes operating with the maximum admissible load close to their maximum extension. From this literature reference it is also known, in the case of a negative loading, for example, when lowering a load, to use a combination of inner and outer slide valve so that the volume flow through the tank connection reduces automatically. An especially slow movement can consequently be achieved, which in the operation of cranes is advantageous for safety reasons, particularly when lowering loads. This makes the construction of the main valve very complicated, though.

The invention is based on the problem of providing a hydraulic system combining improved control facilities with a simple construction.

This problem is solved in a system of the kind mentioned in the introduction in that the valve arrangement has a controllable degree of opening.

This measure enables the pressure difference across the main valve to be controlled or regulated not only as hydraulic fluid is flowing to the motor but also as it is returning to the tank. The opportunities for intervention, which can be used for a more rapid regulation or control, are therefore increased. In particular, fluctuations in the hydraulic system can be suppressed. With a negative loading, that is, when the work motor is operating as a pump, the volume flow between the main valve and the tank can additionally be controlled. Because of that, the main valve can be kept fully open, for example as a load is being lowered. It is also no longer necessary for the volume flow to be restricted by the input compensating valve, which results in a minimum pressure demand on the pump. This leads to greater efficiency, since the power loss in the main valve and in the input compensating valve can be sharply reduced. Moreover, reliability is improved through an increased redundancy, since the volume flow from the work motor to the tank can be interrupted both by the main valve and by the additional valve arrangement. Even if one of these two parts should be defective, the other part is still in a position to hold the work motor, or rather the load suspended thereon, so that unintentional lowering of the load can be avoided. The volume flow from the main valve to the pressure sink can be influenced in a controlled manner.

Advantageously, the valve arrangement is in the form of a compensating valve, namely, an output compensating valve, and at least one of the compensating valves is controlled by a load-sensing signal derived from a pressure in the work connections; a control arrangement which controls the pressure of the load-sensing signal to influence the degree of opening of the compensating valve is provided. Control of the degree of opening can be effected here in dependence on the pressure drop across the main valve. Control or regulating modes which are known from the input compensating valve can therefore be followed. By changing the load-sensing signal, the pressure drop across the main valve can be influenced. The volume flow through the main valve is hereby influenced without the position of the main valve having to be changed. The volume flow may, of course, if desired, still be influenced by changing the position of the main valve, as before. There are therefore an increased number of control possibilities which can be used, inter alia, to reduce the movements of the main valve, or more accurately, of the slide of the main valve. Since the slide of the main valve generally has a relatively large mass, which has to be accelerated and braked during a change in its position, through control of the pressure of the load-sensing signal, and consequential control of the volume flow, a considerably faster adjustment of the volume flow can be achieved. This can be used to advantage for rapid counter-control when fluctuations occur. In addition, the pressure drop across the main slide valve can be reduced if the volume flow requirement is small, which leads to a marked reduction in power loss and thus to an increase in efficiency. Because the new method of control enables the pressure across the main valve to be increased, existing proportional valves can also be upgraded to a much higher nominal volume flow. This is very advantageous in particular when a large volume flow demand occurs only briefly. It is quite possible to accommodate the main valve and the compensating valves in a common unit. The main valve is then formed by a main slide valve section and the compensating valve or valves is/are formed by one or two compensating slide valve sections. To ease understanding of the following explanation, however, reference will be made to separate valves.

Generally speaking, provision is made for the control arrangement, both in the case of positive loading and in the case of negative loading, to adjust the pressure of the load-sensing signal associated with the input compensating valve to a positive or a negative value. The possibilities for control are therefore considerably extended. Depending on the desired operational behaviour of the associated work motor, the desired adjustments can be set or adjusted by increasing or reducing the pressure of the load-sensing signal that is associated with the input compensating valve. For example, when the loading is negative, the control arrangement lowers the pressure of the load-sensing signal associated with the input compensating valve to a predetermined value and sets the degree of opening of the input compensating valve to a predetermined value. The input compensating valve can therefore be completely closed, for example when the loading is negative. This does not have to be so, however. In other cases it may be desirable to operate with a pressure on the opposite side of the piston of the work motor. This counter-pressure can then be adjusted.

If the control arrangement increases the pressure of the load-sensing signal associated with the input compensating valve, for example with a positive loading, then the input compensating valve provided between the pressure source and the main valve can be controlled by the control unit to achieve a greatest possible degree of opening. This means that the pressure drop across the main valve can also be set to quite a large value. The volume flow through the main valve can consequently be correspondingly increased. It can be made considerably larger than would be the case with a conventional compensating slide valve, which has to ensure a constant pressure drop across the main valve. Changes in the volume flow and thus changes in the speed of movement of the work motor can then also be achieved without moving the slide in the main valve, by opening the compensating valve to a greater or lesser extent.

When the loading is positive, that is to say, whenever by filling one work chamber for the purpose of lifting or moving a load, the other work chamber is to be emptied into the pressure sink, the output compensating valve opens automatically virtually completely, and no resistance is built up by the output compensating valve. The hydraulic system then functions like a conventional system without an additional valve arrangement in the output connection. Reducing the load-sensing signal for the output compensating valve can be achieved simply in that, using the valve arrangement, or more accurately, the minus valve, the load-sensing signal is connected, for example, to the output connection. By way of the restrictor device, the pressures of the load-sensing signals connected to the input compensating valve and the output compensating valve are isolated, so that a separate control of the input compensating valve is possible without any problem even when the output compensating valve is fully opened.

Advantageously, the pressure of the load-sensing signal is separately adjustable for each compensating valve. Different choices for adjustment can thus be implemented for the input line and the output line, without having to accept an interdependence of the degrees of opening of the input compensating valve and output compensating valve.

Advantageously, at least in the case of one compensating valve, a counter-pressure acting oppositely to the pressure of the load-sensing signal is adjustable. Control of one compensating valve can be achieved firstly in that the pressure of the load-sensing signal is increased or reduced. Instead of increasing the pressure of the load-sensing signal, it is alternatively possible to lower a counter-pressure. In that case, further adjusting and control opportunities are opened up.

To separate the two load-sensing signals from one another, provision is advantageously made for the load-sensing signals for the two compensating valves to be isolated from one another by a restrictor device, which has a separate restrictor for each load-sensing signal. The pressure at the two compensating valves can then be adjusted by volume flows of different magnitude through the load-sensing signal line.

A control valve arrangement which lowers or raises the pressure of the load-sensing signal, or lowers the counter-pressure, is preferably provided at least for one compensating valve. This can be achieved in a simple manner in that the control valve arrangement connects the load-sensing signal to a point of relatively low pressure, for example the tank pressure, or to a point of relatively high pressure, for example the pump pressure or to the output of the compensating valve. To lower the counter-pressure, the counter-pressure may, of course, also be connected to a point of relatively low pressure, for example the tank pressure. In this way, opportunities of adjusting the pressure of the load-sensing signal within relatively wide limits are provided.

For that purpose, the control valve arrangement preferably has a plus valve for increasing the pressure of the load-sensing signal, or for lowering the counter-pressure, and/or a minus valve for lowering the pressure of the load-sensing signal. For each compensating valve, the control valve arrangement requires therefore a maximum of two valves. If certain setting possibilities are sacrificed, it may even be sufficient for all compensating valves to have just a single common minus or plus valve.

The plus valve and the minus valve are advantageously in the form of controllable restrictors, especially pulse width modulated electromagnetic valves. The pressure of the load-sensing signal can consequently be controlled so as to achieve not just two extreme values, but also to achieve values lying between these values. Pulse width modulated electromagnetic valves are easy to control electrically. They also permit a very rapid response to control signals.

A priority shuttle valve is preferably arranged between the input connection and the output connection of the main valve, the output of which is connected by way of a restrictor to the counter-pressure input of the output compensating valve, the minus valve being arranged between the connection of the restrictor and the output compensating valve on the one hand and the pressure sink on the other hand. This creates the counter-pressure on the output compensating valve. The minus valve can be used to lower the counter-pressure in order to close the output compensating valve.

It is also preferred for a compensating slide valve to be arranged between the plus and minus valves respectively connected to the pressure sink and the pressure sink. This compensating slide valve reduces the pressure difference across the plus and minus valves respectively. This is especially advantageous when pulse width modulated electromagnetic valves are being used as the plus and minus valves. A load-sensing shuttle valve, in particular in the form of a ball shuttle valve, at the output of which the load-sensing signal is available, can be arranged between the two work connections of the work motor. Through the load-sensing shuttle valve it is possible in a simple manner to obtain as the load-sensing signal always the higher of the two pressures in the work connections. It may be advantageous here to supply the load-sensing signal to an input of a main control shuttle valve, the other input of which receives a load-sensing signal of a different hydraulic system supplied by the same pressure source. In this manner it is possible to supply several hydraulic systems with one pressure source yet nevertheless ensure that the pressure source always operates in dependence on the largest demand arising. Inadequate supply to individual hydraulic systems cannot therefore occur.

In an especially advantageous embodiment, provision is made for the control arrangement to have one or more sensors which establish whether the loading on the work motor is positive or negative. Depending on the decision of this question, different control modes can be implemented.

For example, problems and forces occurring when raising a load differ from those occurring when lowering a load. This is significant in particular for safety reasons.

For that purpose, the sensors have a loading sensor which establishes which work chamber of the work motor is at the higher pressure and in particular detects the position of a valve member in the load-sensing shuttle valve connected between the two work connections; the sensors also have a position sensor which detects the position of the main valve. The loading sensor can alternatively also be in the form of a position sensor which detects the position of the valve member of the shuttle valve. The shuttle valve, of which the valve member position is to be detected need not necessarily be identical with the load-sensing shuttle valve. The opportunity presents itself, however, to use an existing shuttle valve also for the purpose of determining the pressure. Using the position of the main valve, it is possible to establish which work connection is connected to the pressure source and which is connected to the pressure sink. When the pressure in the work connection connected to the input connection is the higher pressure, the loading is positive. When the pressure in the work connection connected to the output connection is the higher pressure, the loading is negative.

In an alternative or additional embodiment, the sensors may have a pressure comparator, in particular in the form of a position sensor which detects the position of a valve member of a further shuttle valve, which is arranged between the input connection and the output connection of the main valve, which pressure comparator determines whether the pressure is higher in the input connection or in the output connection of the main valve. With this arrangement, the pressure is detected upstream of the main valve, that is, on the side of the main valve remote from the work motor. If the pressure is higher in the input connection, the loading is positive. If, on the other hand, the pressure is higher in the output connection, then the loading is negative. This is on condition that at least one of the two compensating valves is at least partially closed and that the further shuttle valve is arranged between the main valve and the two compensating valves.

Depending on the position of the respective valve members, the sensors advantageously produce binary value output signals in electrical, pneumatic or hydraulic form. Such output signals are easily processed. Because the valve members are only able to assume two defined positions of interest, evaluation in binary form, that is, in the form of signals that represent a zero or a one in each case, are completely satisfactory.

In a preferred embodiment, provision can also be made for the output compensating valve to open, when the loading is positive, by means of the associated counter-pressure that acts by way of the pressure line, the further shuttle valve and the restrictor. In that case, the counter-pressure counteracts the load-sensing signal and urges the compensating valve into the opened position.

A top-up valve is also preferably provided between the main valve and the pressure sink. A non-return or unidirectional valve that blocks in the direction of the pressure sink can be used as the top-up valve. Normally, one would assume that with a negative loading the input compensating valve would have to be fully open for lowering purposes. In the embodiment described here, however, this effect is not used. On the contrary, parallel to the input compensating valve there is provided a top-up valve connected to the pressure sink, so that the other work chamber of the work motor can be topped up. Lowering the pressure of the load-sensing signal has the great advantage, however, that the pressure source is also informed that there is no demand for pressure at that moment. The pressure source need not therefore become active at all as a load is being lowered. Despite this, a controlled lowering of the load or a controlled movement of the work motor with a negative loading presents no problems. This manoeuvre can easily be performed by the output compensating valve.

Preferably, the output compensating valve closes when the loading is negative under the effect of the load-sensing signal and spring. An intrinsic safety is consequently achieved. With negative loading, the output compensating valve closes without further measures. Blocking or self-locking of a load can be achieved by that means.

In particular when the loading is negative, "clamping" of the load, that is to say self-locking, can be achieved.

For that purpose, it is especially preferred for the control arrangement to provide controlled lowering of the pressure of the load-sensing signal associated with the output compensating valve. The control unit consequently takes over the movement control of the work motor. The volume flow to the pressure sink can be reduced both by the main valve and by the output compensating valve. Even if one of these two valves is defective, the faults caused thereby cannot lead to a dangerous situation.

In a further advantageous construction, a change-over valve is provided, the position of which depends on whether the loading is positive or negative, and which in one position connects the load-sensing signal to the input compensating valve and the minus valve associated with it, and in the other position connects the input compensating valve to the pressure sink and the minus valve to the output compensating valve and the load-sensing signal. A number of plus and minus valves can consequently be omitted. Basically, only a single minus or plus valve for the two compensating valves is necessary. Only a limited number of adjustments can be performed with that construction, however. In particular, it is not possible to open the input compensating valve further than prescribed by the load-sensing signal.

Advantageously, the change-over valve can be actuated hydraulically and switches over when the loading changes from positive to negative or vice versa. The change-over can consequently be carried out without electrical actuation. A simple, very fast-acting change-over valve can be used which changes over even at very low pressure differences. If the change-over valve does not require electrical energy, change-over can be effected independently of any errors in the control arrangement. This further increases the extent to which the system is fail-safe.

In this connection it is preferable for the hydraulically activatable change-over valve to have two work chambers which are connected to the input connection and output connection respectively, the hydraulically actuated change-over valve and the further shuttle valve being put together with common work chambers. This creates a simple construction of the change-over valve, which can be integrated into a valve block. The construction of the system is further simplified because the two valves can be arranged in a common housing with common control connections.

In a preferred construction, the main valve is in the form of a direction-determining proportional valve, wherein to change the volume flow the control arrangement carries out an approximate control of the volume flow by means of the compensating valves and a more precise regulation by means of the main valve. The new system can then be used with existing systems. The additional valves can be used with conventionally known proportional valves. A very fast control is consequently achieved in which the positive properties of the various types of valve can be exploited to the full.

In a preferred embodiment, the main valve is in the form of shuttle valve of constant area and with a neutral position. This provides an extremely fast valve. This is admittedly only a direction-determining valve, but a volume flow control function can be omitted since this control is performed by the compensating valves. Since the compensating valves are controlled by means of the load-sensing signal, which valves in turn are controlled by pulse width modulated electromagnetic valves, control of the volume flow is very fast. The control is so fast that fluctuations occurring can be damped very quickly by a counter-phase control of the compensating valves, particularly when a sensor for detecting the fluctuations is present in the hydraulic system. Moreover, the manufacture of a main valve that merely has a directional function is very simple and inexpensive. Such a valve can be produced with a large tolerance towards faults.

In a further preferred embodiment, the main valve can be in the form of a bridge circuit of positively controlled valves. As a result, the main valve can be made up of four individual relatively simple and individually acting valves, the function of which is limited to opening when a control signal appears and closing when no control signal is present. An extremely fast control can also be achieved by this means.

The valves of the bridge circuit are preferably in the form of positively controlled electrically and/or hydraulically and/or pneumatically and/or mechanically activatable ball shuttle valves. The main valve is consequently constructed from valves in which the pressure in the closed state contributes to the seal of the valves, so that only very slight leakage, if any, is able to occur. When there is no control signal, the ball valves close very quickly on account of the pressure. This contributes to a further increase in reliability.

In this connection, it is preferable for an auxiliary fluid source to act by way of control valves on control inputs of the valves of the bridge circuit. The auxiliary fluid source is able to make control energy available for changing over the shuttle valves. The auxiliary fluid source need not be formed by a separate pump. The pressure can also be taken from the pressure source.

To increase reliability further, provision is made for the control arrangement to have a comparator unit for detecting at least one error state in the valves and/or the control arrangement, the control arrangement switching all valves to no-load when an error state occurs. Since further movement of the work motor is impossible with the valves closed, the system is locked in its current state, that is to say, the state when the error appears. This locking can occur more quickly than it does in the conventional system, since the compensating valves are able to close more quickly than the main valve is able to move into its neutral position.

In an advantageous construction, the electromagnetic valves interrupt the volume flow through the input compensating valve and the output compensating valve in the absence of control signals. This ensures that a load remains suspended when an error occurs in the system and does not drop uncontrollably. For that purpose, the minus valves are preferably in the form of normally-open valves and the plus valves and control valves are in the form of normally-closed valves. This structural feature enables the volume flow to be interrupted very easily in the absence of auxiliary energy, with the result that the load remains hanging.

The control arrangement preferably contains at least two processing units working in parallel which receive the same input signals, and a comparator unit which compares output signals and/or intermediate signals of the processing units and registers an error state in the event of anomalies. Normally, the two processing units would have to operate exactly in parallel, that is, their output signals and also their intermediate signals, that is, the signals between individual stages of the processing units, would have to coincide. If there are anomalies, one of the two processing units must be defective. For safety reasons, an error state is then registered and corresponding measures are taken for giving a warning, eliminating the error or stopping the system.

In a further construction, at least three processing units are provided. The comparator unit produces an auxiliary error signal when just one processing unit produces an output or intermediate signal differing from the others; when there are more than two processing units and inconsistency between signals occurs, the comparator unit identifies the deviant processing unit and disables this processing unit. If just one processing unit is producing deviant signals, it is highly probable that it is just that processing unit that is defective. In that case, it is sufficient to produce an auxiliary error signal to indicate the fact that a processing unit is defective and has to be repaired or replaced. Emergency operation can be maintained with the remaining processing units. Even when an error occurs, it is thereby possible to restore the system to a state which allows safe access, for example, allows a suspended load to be lowered. It is possible for the system to continue operating even when there is an error in one processing unit. This means that a suspended or raised load can be lowered without any risk to safety.

Advantageously, the work motor is a steering motor of a vehicle steering system. In steering systems for vehicles, safety requirements are relatively high. The present system satisfies these requirements to a great extent. Virtually all the important components are designed with a redundancy factor, so that for the majority of errors dangerous situations cannot occur.

In this connection, the system is preferably constructed with a redundancy factor from at least two valve sections, which are controlled by independent electronic processing units, the valve sections, of which there are at least two, being connected in parallel and supplying the same work cylinder. In this manner a control system for land vehicles or ships is created that is relatively comprehensively proof against errors, almost every error being compensated so that continued operation is possible without an operator having to alter the operation or control of the vehicle. The system can be used as a control system for existing vehicles, that is to say, it can be retrofitted. Because the valve sections are designed so that there are several possible ways of interrupting the volume flow, a defective valve section can be closed with a high degree of safety. It then no longer has any effect on the parallel valve section. When the control means receive their input signals from detectors that are connected to control members of the vehicle, the vehicle can be operated by means of a relatively small steering hand wheel if there is no requirement for the control unit to provide torque. At the same time, the vehicle can be steered using a "joy-stick", that is, a control stick, without any change to the control system being required. It also becomes possible for the vehicle to be controlled from various operating positions. The system can also be constructed so that the vehicle is linked to a remote-control system and the operator remains outside the vehicle. The system can also be embodied with a driverless control system, which operates with a guiding line, that can be of mechanical, electronic, magnetic, optical or similar construction. Vehicles equipped with such control systems can then operate largely autonomously. When detectors that report back to the control units are provided at the output of the work motor, the system can operate as a closed control loop. At the same time, the monitoring electronics formed by the control arrangement are therefore able to monitor the function of the control system. If the control arrangement has means for limited correction of anomalies between signals from detectors of the control members and check-back signals from the detectors at the output of the work motor, relatively small anomalies, which are virtually inevitable on account of leakages in the hydraulic system, can be compensated before the anomalies become so marked that they are noticed by an operator.

Figure 1A:
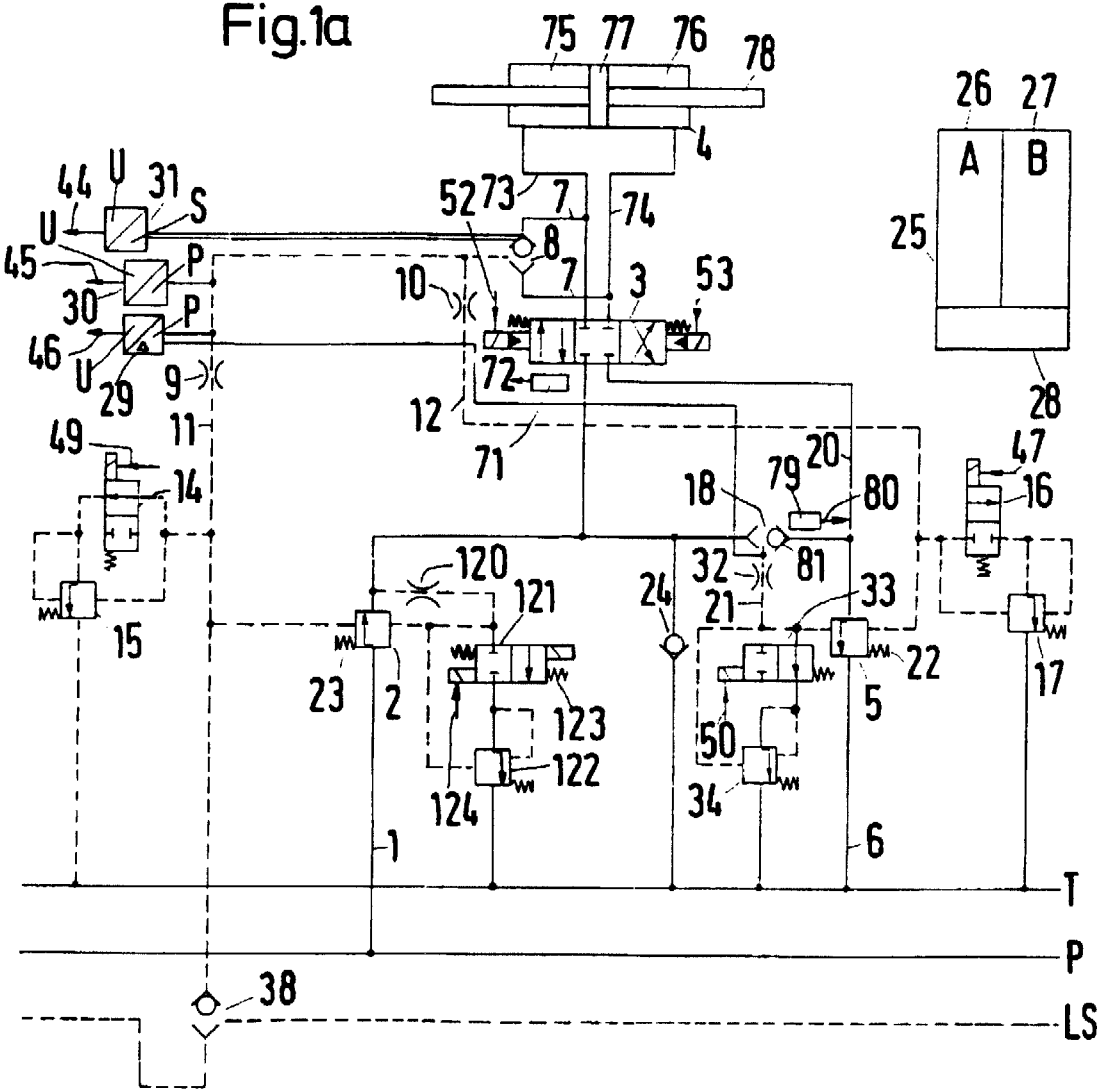
Figure 2:
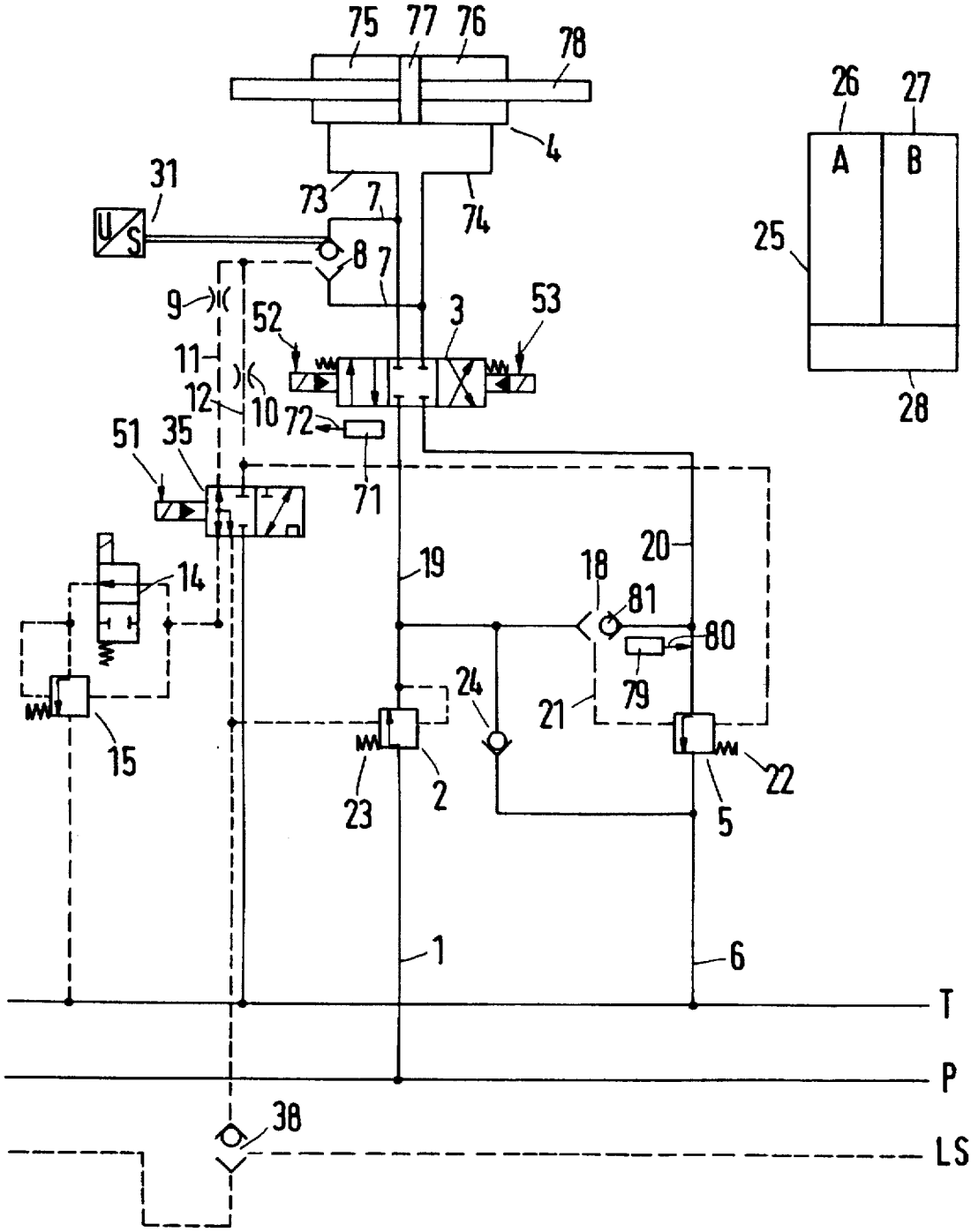
Figure 3:
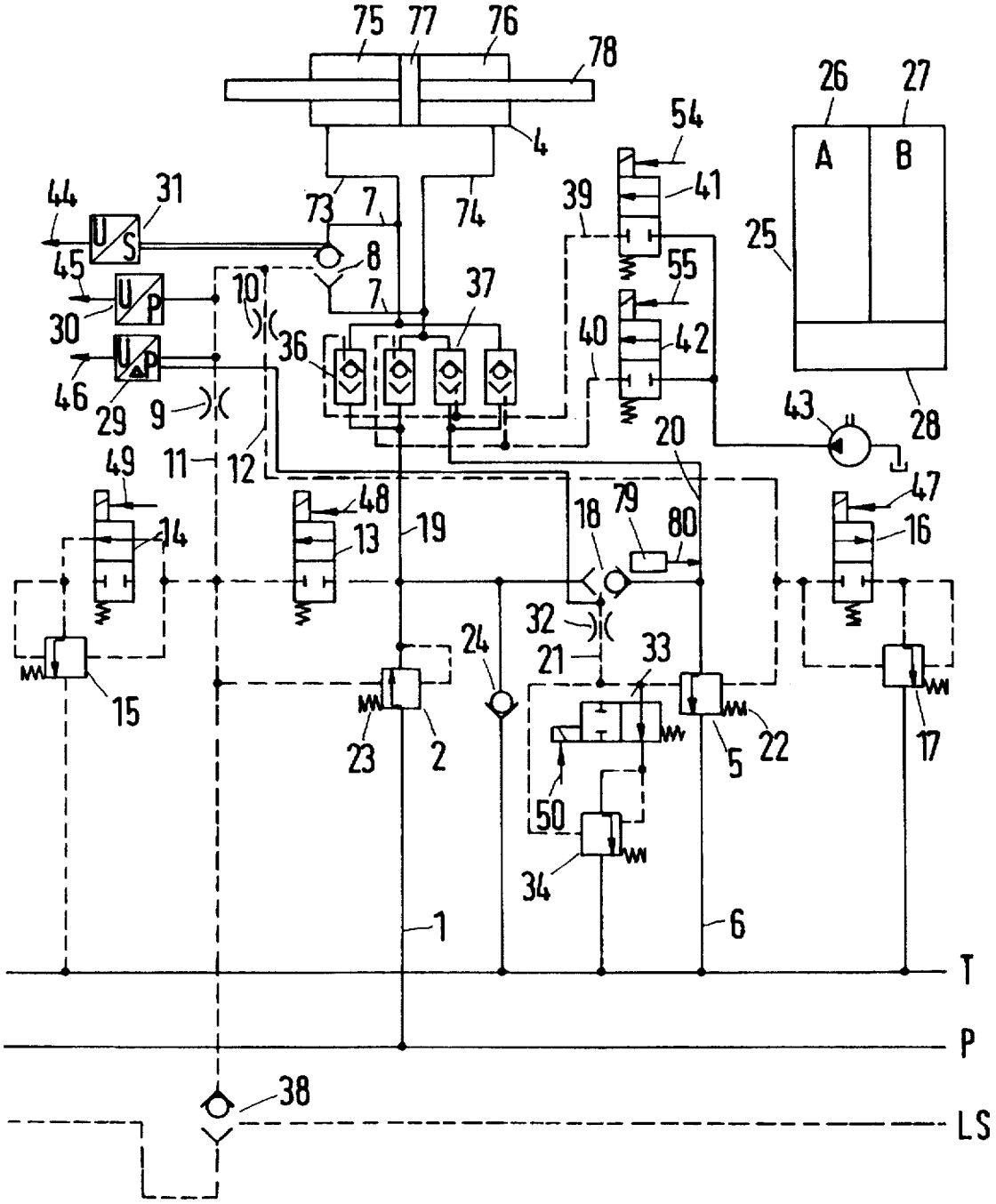
Figure 4:
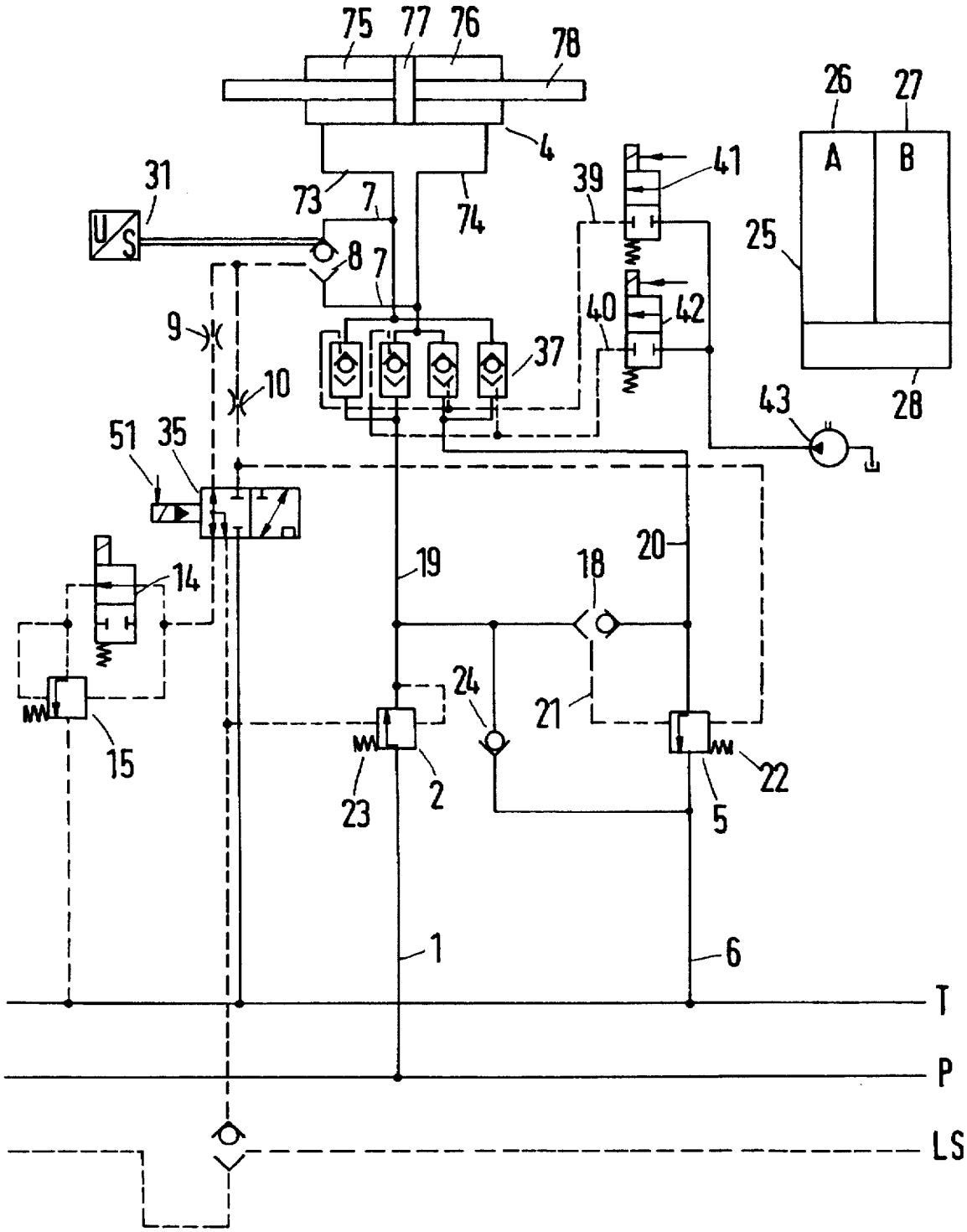
Figure 4A:
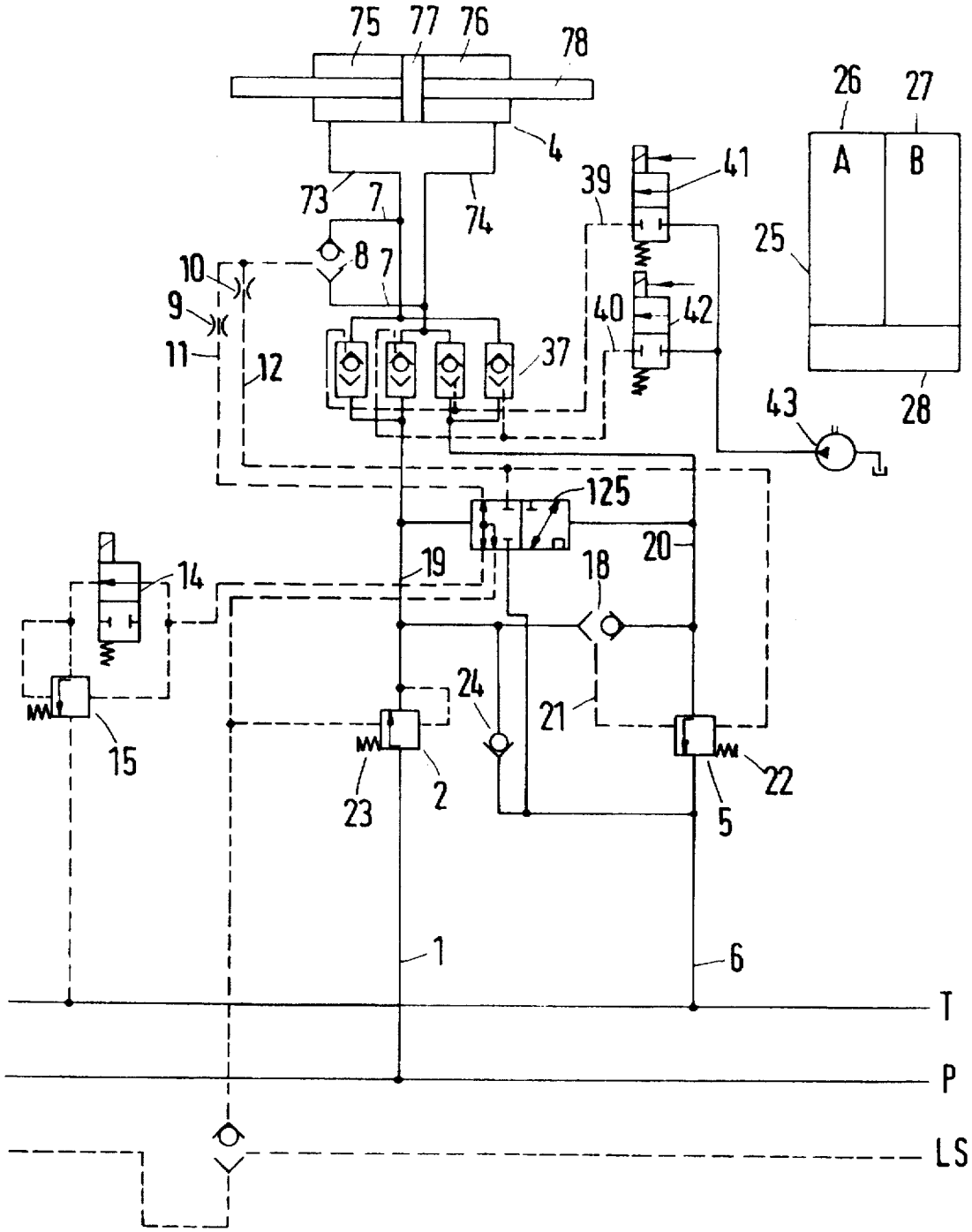
Figure 5:
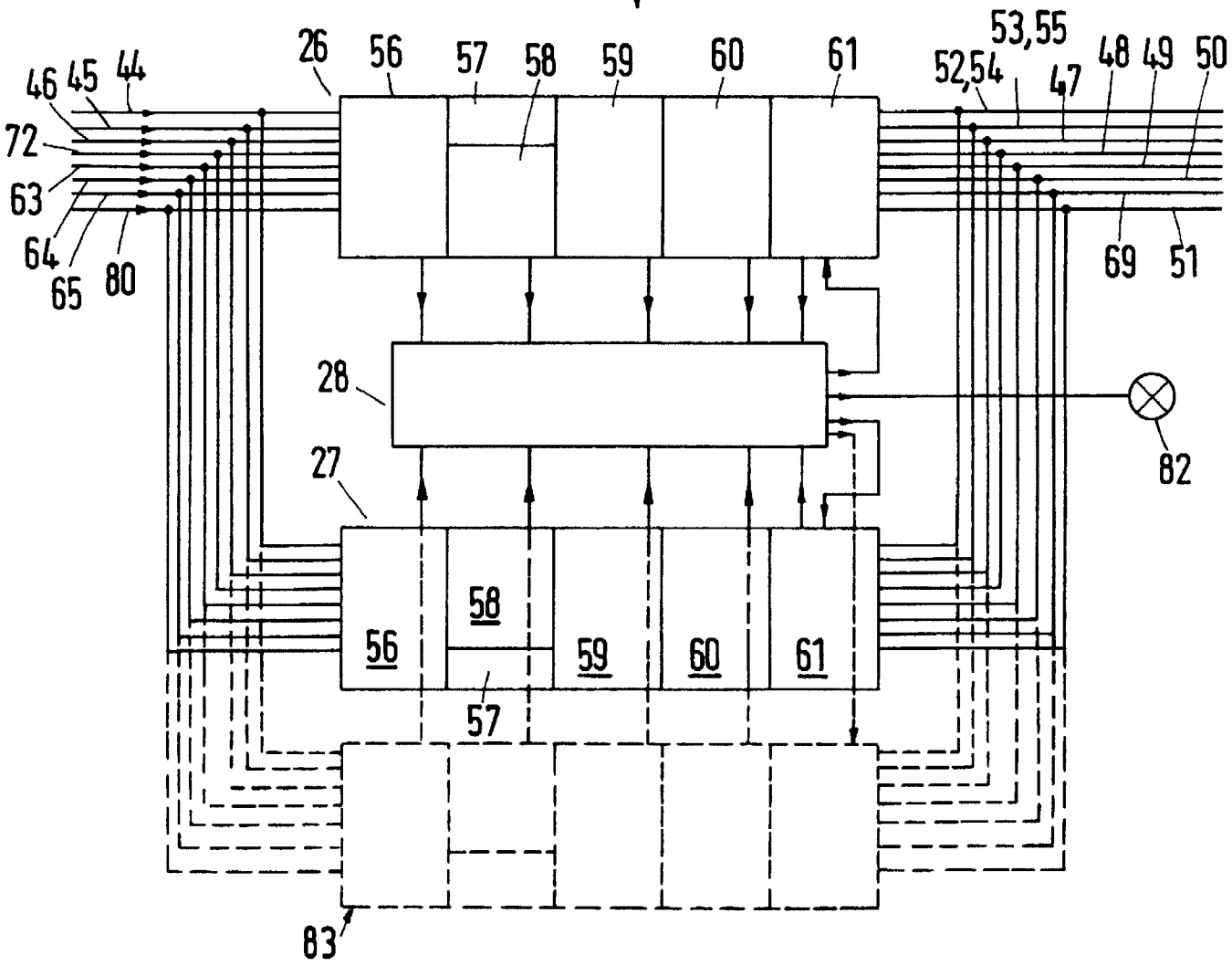
Figure 6:
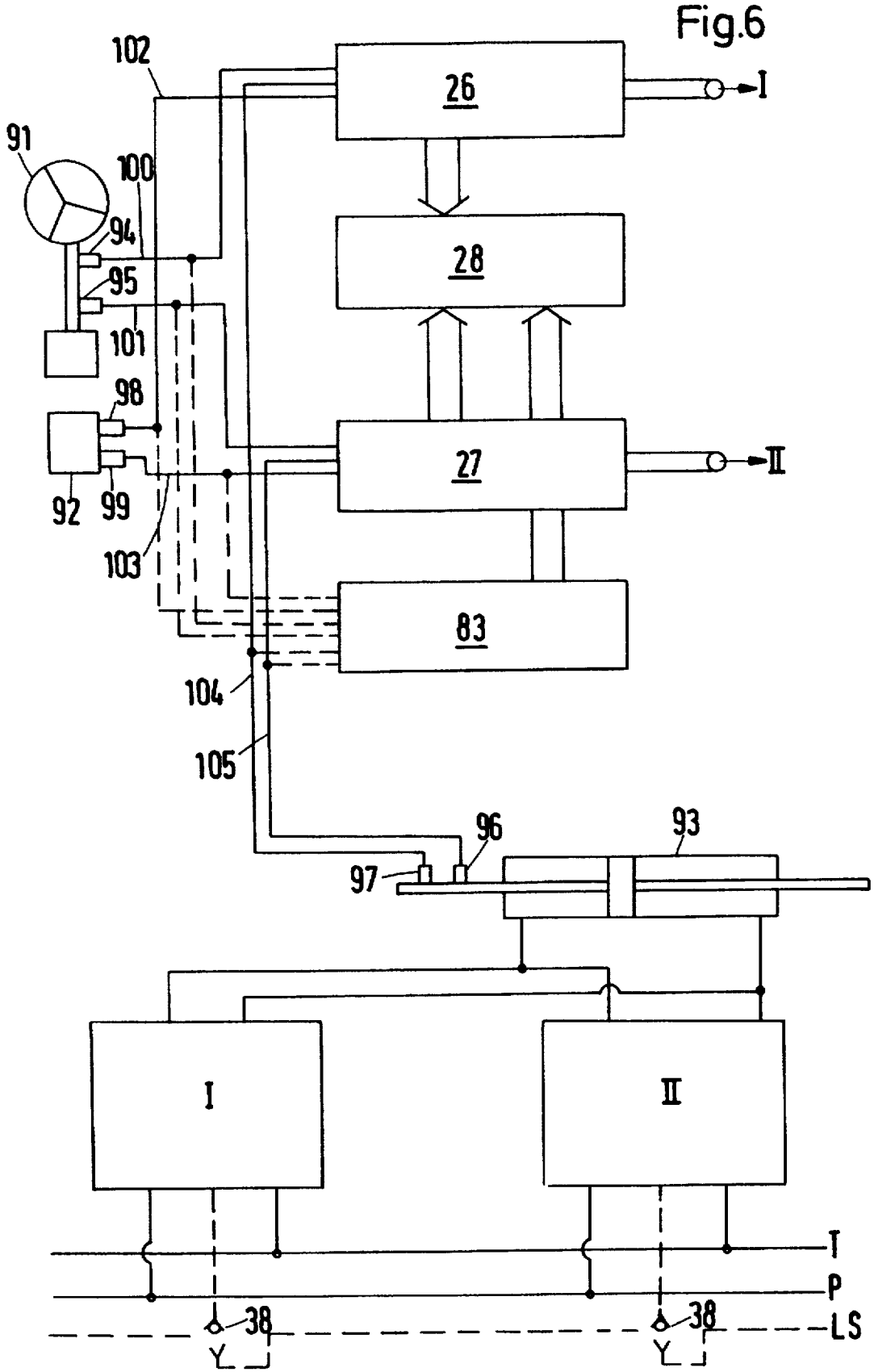

The invention is described hereinafter with reference to preferred embodiments and in conjunction with the drawing, in which FIG. 1 shows a first embodiment of the invention, FIG. 1*a* shows an alternative construction to FIG. 1, FIG. 2 shows a simplified embodiment of the invention, FIG. 3 shows an embodiment of the invention corresponding to FIG. 1 with a different main valve, FIG. 4 shows an embodiment corresponding to FIG. 2 with a different main valve, FIG. 4*a* shows an alternative construction to FIG. 4, FIG. 5 shows a diagrammatic representation of a control unit and FIG. 6 shows a diagrammatic representation of an extended system.

A hydraulic system illustrated in FIG. 1 comprises a pump line 1 connected to a pump connection P serving as the pressure source, through which line the hydraulic fluid can be conveyed to a main valve 3 by way of an input compensating valve 2 and an adjoining input line 19. The main valve 3 can be constructed with a conventional, known slide valve as a proportional valve. From the main valve 3 two work connections 73, 74 lead to a work motor 4. The work motor 4 can be moved in both directions. For that purpose it has two work chambers 75, 76, separated by a piston 77, connected to the work connections 73, 74. The piston moves a piston rod 78. The work motor 4 can be used, for example, in a crane to raise a boom, or it can be used in a vehicle steering system to move the steered wheels of the vehicle in a specific direction.

The main valve 3 is connected by way of an output line 20 to an output compensating valve 5. The output compensating valve 5 is connected by way of a tank line 6 to a tank connection T serving as the pressure sink.

Hydraulic fluid supplied from the pump connection P therefore passes through the input compensating valve 2, the input line 19 and the main valve into a work connection 73, 74 defined by the main valve 3 and then into the work chamber 75, 76 of the work motor 4 connected to this work connection 73, 74, and moves the piston 77 in the appropriate direction. The hydraulic fluid displaced from the other work chamber 76, 75 then passes through the other work connection 74, 73 to the main valve 3 and from there by way of the output line 20, the output compensating valve 5 and the tank line 6 to the tank connection T.

The two work connections 73, 74 of the main valve 3 are connected by way of pressure connections 7 to a shuttle valve 8. The shuttle valve 8 relays the higher pressure in each case to a restrictor arrangement formed by two restrictors 9, 10. A load-sensing signal, which is also referred to in the literature as an LS-signal, is consequently available at the output of the restrictor arrangement, that is to say, on the lines 11 and 12.

The line 11 is connected to a control input of the input compensating valve 2. The line 11 is additionally connected to an input of a main control shuttle valve 38, the other input of which receives a load-sensing signal of a further hydraulic system, not illustrated, which is supplied from the same pressure source. The load-sensing signal LS having the highest pressure of all the hydraulic systems that are supplied from the same pump P is therefore present at the output of the main control shuttle valve. This load-sensing signal is used in known manner to control this pressure source.

The line 11 is also connected to a valve arrangement formed by two pulse width modulated electromagnetic valves 13, 14. In this connection, the valve arrangement 13, 14 has a plus valve 13, which connects the line 11 with the line 19, that is, the output of the input compensating valve 2, and a minus valve 14, which connects the line 11 to the tank connection T. The plus valve 13 is closed in its rest position, and the minus valve 14 is open in its rest position.

Between the output of the minus valve 14 and the tank connection T there is connected a further compensating valve 15, so that the pressure difference across the minus valve 14 is not allowed to become too great. The plus valve 13 has a control input 48 and the minus valve 14 has a control input 49, by means of which the degree of opening of the two valves 13, 14 can be adjusted.

When the plus valve 13 opens, the pressure on the line 11 is increased, that is to say, the load-sensing signal which is supplied to the input compensating valve 2 receives a higher pressure. When the minus valve 14 is opened, the pressure on the line 11 is decreased, that is to say, the pressure of the load-sensing signal drops. In the first case, the degree of opening of the input compensating valve 2 is enlarged, since the load-sensing signal, together with a spring 23, acts in the opening direction on the input compensating valve 2, and in the other case the degree of opening of the input compensating valve 2 is reduced.

Controlling the degree of opening of the input compensating valve 2 enables the pressure difference across the main valve 3 to be adjusted and accordingly also the volume flow through the main valve 3.

The line 12, which also carries the pressure of the load-sensing signal, is connected to a control input of the output compensating valve 5 and acts on the output compensating valve 5, together with a spring 22, in the closing direction. The line 12 is connected to a minus valve 16 which in turn is connected by way of a compensating valve 17 to the tank line T. The minus valve 16 has a control input 47, by means of which it is electrically controllable. The minus valve 16 can be constructed as a pulse width modulated electromagnetic valve as well. The minus valve 16 is closed in its rest position.

A counter-pressure present on a line 21 acts on the output compensating valve 5 in the opening direction. The line 21 is connected by way of a restrictor 32 to a shuttle valve 18. The shuttle valve 18 is connected on one side with the line 20 and on the other side with the line 19. The higher of the two pressures in the pump connection and in the tank connection of the main valve 3 is therefore always present upstream of the restrictor 32, that is, at the output of the shuttle valve 18.

The line 21 is connected by way of a plus valve 33, with which a compensating valve 34 is connected in series, to the tank line T also. By opening the plus valve 33 the pressure on the line 21 can be reduced. The counter-pressure on the output compensating valve 5 is consequently reduced and the output compensating valve is moved under the influence of the load-sensing signal on the line 12 and the spring 22 in the closing direction. The plus valve 33 is open in its rest position.

A position sensor 79, located adjacent to the shuttle valve 18, detects the position of the valve member 81, a ball, in the shuttle valve 18 and emits a corresponding position signal by way of a line 80. Using this signal the control arrangement illustrated in FIG. 1 is able to determine whether the loading is positive or negative. With a positive loading, the force from the motor on the opposing force acting on the motor is greater than the opposing force. When the loading is negative, the acting opposing force is greater than the force exerted by the motor. The loading is positive, for example, when the work motor 4 is lifting a load, for example, is pivoting the boom of a crane upwards. The loading is negative on the other hand when the boom is to be lowered with no or only slight pump pressure. With a positive loading, the pressure in the input line 19 is greater than in the output line 20. With a negative loading, the converse is true.

Another possible way of determining whether the loading is positive or negative is achieved by means of a sensor 71 which by way of a line 72 emits a signal providing information about the position of the slide of the main valve 3. Furthermore, a sensor 31 is provided which detects the position of the valve member in the shuttle valve 8 and emits a signal by way of a line 44. The presence of a positive or negative loading can also be determined from the combination of the position of the slide in the main valve 3 and the pressure in the work connections 73, 74. If the pressure is higher in the connection connected by way of the main valve 3 to the pressure source, the loading is positive. If the pressure is higher in the work connection 73, 74 connected to the pressure sink by way of the main valve 3, then the loading is negative.

With a positive loading, the pressure in the input line 19 will always have a higher value than the pressure in the output line 20. This pressure in the input line 19 is relayed by way of the shuttle valve 18 and the restrictor 32 to the output compensating valve 5 and acts on this in the opening direction. The pressure in the output line 12, which is dependent on the pressure of the load-sensing signal, always has a lower value because of the pressure drop in the main valve 3. When the force of the spring 22 is designed to be relatively low, the output compensating valve will always be fully opened when the loading is positive. If it is desired to interrupt the discharge of hydraulic fluid from the corresponding work chamber 75, 76 to the tank, the plus valve 33 can be opened, whereupon the counter-pressure is reduced and the output compensating valve is either closed to prevent a discharge, or the degree of opening is reduced, to throttle the discharge.

That feature creates a relatively high degree of safety in the system illustrated. Regardless of errors in the main valve 3, it is possible to block the connection from the main valve 3 to the tank T by means of the plus valve 33 and the output compensating valve 5. Safety is consequently achieved by redundancy, because at least two valves, namely, the main valve 3 and the output compensating valve 5, have to fail at the same time for serious disruption to occur.

When a negative loading occurs in the system, this means that the pressure in the output line 20 is higher than the pressure in the input line 19. Accordingly, pressure is conveyed to the counter-pressure input of the output compensating valve 5 by way of the ball valve 18, the restrictors 32 and the line 21. The pressure on the output line 20 thus acts in the opening direction on the output compensating valve 5. At the same time, the negative loading causes the valve member in the shuttle valve 8 to change position. The pressure of the negative loading then acts on the load-sensing lines 11 and 12. In that case, the pressure on the line 12 is higher than the pressure on the output line 20, because the pressure drop across the main valve 3 acts in the reverse direction. The pressure on the line 12 therefore acts, together with the spring 22, in the closing direction on the output compensating valve 5, so that with a negative loading the work motor 4 is automatically prevented from emptying towards the tank. This leads to a self-blocking of the work motor when the loading is negative, which is advantageous in particular as far as cranes are concerned when it is desirable to prevent uncontrolled lowering of the load also in the event of error states occurring.

So that the pressurized work chamber 75, 76 can be emptied towards the tank T in the event of the loading being negative, by reducing the pressure on the line 12, that is, by reducing the pressure of the load-sensing signal, the output compensating valve 5 can be opened. This is effected by opening the minus valve 16. Together with the restrictor 10, this creates a pressure divider, so that the closing pressure acting on the output compensating valve 5 can be adjusted. Because the minus valve 16 is likewise pulse width modulated, the degree of opening of that valve can be controlled, and thus the volume flow through the output compensating valve 5 can be adjusted.

With a negative loading, the highest pressure is transmitted by way of the line 11 and the main control shuttle valve 38 to the pressure source. The pressure source is consequently controlled so as to obtain a corresponding pressure value. With a high pressure on the line 11, the pressure source accordingly supplies a high pressure. This is possible when lowering a load. With a negative loading, it is possible to open the minus valve 14, whereupon pressure on the line 11 is reduced to a minimal value. This minimal value is transmitted by way of the main control shuttle valve 38 to the pressure source which, if there is no demand for a higher pressure, can be adjusted to a low output pressure. Lowering the load when the loading is negative can therefore be effected without volume flow from the pressure source. Since the input compensating valve 2 is closed by this measure, however, a top-up valve 24 is provided, by means of which the other work chamber 75, 76 of the work motor 4 can be replenished with hydraulic fluid from the tank connection T. Because control can be effected without using pump pressure when the loading is negative, losses are kept to a minimum and the degree of efficiency is increased.

So that the control arrangement 25 can operate in accordance with requirements, it requires certain information. A pressure-to-voltage transducer 29 is therefore provided which measures a differential pressure across the main valve 3. Furthermore, a pressure-to-voltage transducer 30 is provided which ascertains the pressure of the load-sensing signal, that is, the pressure at the output of the shuttle valve 18. The sensor 31, which is in principle a displacement-to-voltage transducer and which ascertains the position of the valve member in the shuttle valve 8, has already been mentioned above. The three transducers provide signals on the lines 46, 45 and 44, which signals are supplied to the control arrangement 25.

The control arrangement 25 can influence the position of the slide in the main valve 3 by way of lines 52, 53. In addition, springs may act on the slider, in particular to bring it into a neutral position. The individual plus and minus valves 13, 14, 16 and 33 can be controlled by way of the lines 47 to 50.

FIG. 1*a* shows an alternative construction to FIG. 1, in which the plus valve 33 is replaced by a plus valve 121. The plus valve 121 has the same function as the plus valve 13.

When operated, it leads, in fact, to a reduction in the degree of opening of the input compensating valve 2. In contrast to FIG. 1, however, this is not achieved by increasing the closing pressure on the input compensating valve 2, but by reducing the opening pressure on the input compensating valve 2. The plus valve 121 accordingly acts also on the other side of the input compensating valve 20, that is, it is arranged between the control side of the input compensating valve 2 opposing the spring 23 and the tank connection T. A spring and an actuating element can likewise be provided for the opposite direction. To provide good working conditions for the plus valve 121, a compensating valve 122 is provided between the output of the plus valve 121 and the tank T. To reduce the amount of pressure medium flowing from the output of the input compensating valve 2 to the tank T, a restrictor 120 is provided between the output of the input compensating valve 2 and the input of the plus valve 121. The plus valve 121 and the restrictor 120 thus create a pressure divider, which adjusts the closing pressure on the input compensating valve 2.

The plus valve 121 can be in the form of a pulse width modulated electromagnetic valve, which is biassed in the opening direction by a spring 123 and in the closing direction by a magnet which is controlled by way of an electrical signal 124.

FIG. 2 shows a further embodiment which is simplified compared with FIG. 1. Instead of four pulse width controlled electromagnetic valves for the plus and minus valves 13, 14, 15 and 33, only a single minus valve 14 with a downstream compensating valve 15 is provided here. A change-over valve 35, which can be controlled by way of a line 51 by the control arrangement 25, is provided for that purpose. This change-over valve connects either the line 11 to the input of the minus valve 14 and to the control input of the input compensating valve 2, or connects the line 12 to the input of the minus valve 14, the control input of the input compensating valve 2 being connected to the tank line T. This also ensures, of course, that the corresponding input of the main control shuttle valve 38 is connected to the tank pressure T. The position of the change-over valve 35 illustrated in FIG. 2 is the position that this valve assumes when the loading is positive. In that case, the load control signal is supplied by way of the line 11 to the control input of the input compensating valve 2 and by way of the line 12 to the control input of the output compensating valve 5. Since the pressure on the input line 19 is supplied at the same time by way of the shuttle valve 18 to the counter-pressure input of the output compensating valve 5, the output compensating valve 5 is moved into the open position when the loading is positive.

When the change-over valve 35 is changed over into the opposite position when the loading is negative, the line 12 is connected to the minus valve 14 and the input compensating valve 2 is connected to the tank T. As a result, both the input compensating valve 2 and the output compensating valve 5 close. The degree of opening of the output compensating valve 5 is controllable, however, by way of the minus valve 14. It is therefore possible to construct the system with just one pulse width modulated electromagnetic valve 14 and the change-over valve 35. The absence of the plus valve 13 means that an increase in the pressure drop across the main valve 3 is not possible.

As is also apparent from the description of FIG. 1 and 2, virtually the only function of the main valve 3 is to determine the direction in which the work motor 4 is operating, that is to say, to establish which of the two work chambers 75, 76 the hydraulic fluid conveyed by the pump P is to enter. For that reason, the main valve can be constructed also as a fixed-area valve, but with a neutral middle position. This valve is simple and inexpensive to manufacture.

FIG. 3 shows another possible embodiment, which corresponds substantially to that of FIG. 1. Identical parts are here also provided with the same reference numbers. The main valve 3, however, is replaced by a bridge circuit 37 comprising four ball shuttle valves 36. These ball valves have the advantage that they close automatically when no control signal is present. The ball valves 36 can be activated electrically, electromagnetically, electromechanically, pneumatically or, as illustrated, hydraulically. The illustrated ball valves 36 are controlled so as to open by a pilot pressure which is supplied in each case from a pilot pressure source 43 through one or two electromagnetic valves 41, 42 by way of pressure connections 39, 40. The ball valves 36 can be manufactured simply and inexpensively. The pressure acting on the balls ensures that they are well sealed in the closed position.

The function of controlling the volume flow through the main valve, to be taken note of in FIG. 1 and 2, has been omitted completely here. In this construction, control of the volume flow is brought about exclusively by the input compensating valve 2 and the output compensating valve 5.

FIG. 4 shows an embodiment which corresponds substantially to that of FIG. 2. Here too, the main valve 3 has been replaced by a bridge circuit 37.

The change-over valve 35 may here, just as in FIG. 2, be changed over by a control signal on an input line 51 from the control arrangement 25.

FIG. 4*a* shows a construction that has been modified slightly compared with FIG. 4, in which the change-over valve 35, which is electrically operable, has been replaced by a hydraulically operable change-over valve 125. The change-over valve 125 is pressurized by the input line 19 between the input compensating valve 2 and the main valve 37 and also by the output line 20 between the main valve and the output compensating valve 5. The change-over valve 125 is therefore influenced both by the supply pressure and by the return pressure. The position of the change-over valve 125 is therefore dependent on which of the two pressures is higher. With a positive loading, the change-over valve 125 has the position shown in FIG. 4*a*. With a negative loading, the change-over valve 125 switches to the opposite position. Because the change-over valve responds to the pressure differences between the input line 19 and the output line 20, it can change over very quickly, even when pressure difference are small.

The control arrangement 25 is illustrated only diagrammatically in FIGS. 1 to 4. It comprises two processing devices 26 and 27 which are connected to a comparator unit 28. A more detailed construction is shown in FIG. 5. The comparator unit compares all output signals and also all intermediate signals from the two processing units 26 and 27 and gives an error indication by way of a display means 82 when the two processing units 26 and 27 are not exactly consistent in operation. Furthermore, the comparator unit 28 may emit a control signal which, over the signal lines 47 to 55, causes all valves to close.

The input signals 44 to 46 and 72 have been discussed in connection with FIG. 1. Here, signals come from the transducers or sensors 29 to 31, 72, 79. A signal from a control handle, not illustrated, can be supplied on line 63. A load-sensing signal can be supplied by way of a line 64. Signals from a central processing device, which is used for simultaneous control of several hydraulic systems, can be supplied by way of a line 65. The line 80 delivers the signal of the sensor 79, which ascertains the position of the valve member in the shuttle valve 18.

All input lines are led to an input module 56, which contains, for example, measuring amplifiers or analog/digital converters. As is apparent from FIG. 5, all input signals are supplied to both processing units 26 and 27 and therefore both input modules 56. From the input modules 56, corresponding output signals are relayed to logic units 58, which have a memory 57. On the basis of the memory 57, the logic units 58 are able to establish whether logically wrong operational states are perhaps occurring amongst the incoming measuring signals. To a certain extent it is possible to determine whether errors are occurring in one or in several transmitters. The logic units 58 are also connected to the comparator unit 28. Corresponding output signals are relayed from the logic units 58 to signal processing units 59. The actual processing of the signals takes place here, that is to say, the input signals are processed to output signals in order to carry out control procedures which have been specified beforehand. From the units 59, the signals are transmitted further to signal conversion modules 60. For example, a pulse width modulation, a different code conversion or a digital/analog conversion takes place here. The signal converters 60 are also connected to the comparator unit 28. From the signal conversion modules 60 the signals are transmitted further to output amplifier modules 61. Here, the final amplification of the signals takes place, where necessary. At the same time, the final amplifiers 61 are the units which the comparator unit 28 is able to influence, so that, when errors occur, all output connections can be interrupted. For example, at an appropriate command of the comparator unit 28, the voltage on all output lines can be made zero.

When errors appear, with the two units 58 which perform the logic signal processing the comparator unit 28 is able to identify in which of the two units 26 or 27 the errors have occurred. The defective module can then be disabled. A limited control of the system is allowed, so that a safe state of the system can be achieved. For example, a suspended load can be lowered.

Shown by broken lines is a third processing unit 83, which is of the same construction as the two processing units 26 and 27. This allows a more extensive processing of errors. If only one of the three units indicated produces results that differ from the other two units, it is assumed that this unit is defective. In that case, operation can be continued with the other two processing units for a limited time. An auxiliary error signal will be produced, however, to indicate that a unit is defective.

The output lines lead to the connections illustrated in FIGS. 1 to 4. The first output line can be led to the connection 52 of the main valve 3 or, in the construction according to FIG. 3, led to the signal input 54 of the electromagnetic valve 41. The next connection leads to the input 53 of the main valve 3 or to the input 55 of the electromagnetic valve 42. The next connections 47 to 50 control the plus and minus valves 13, 14, 16, 33. The output 51 controls the change-over valve 35. The output 69 can lead to a central processing device, as mentioned above. Considerably more inputs and outputs can be provided, of course, should this be necessary, for example so that further sensors can be connected or further valves can be controlled.

The embodiments illustrated can be modified in many respects. In particular, the individual transducers can also be used in combinations other than those shown. The control unit 25 can be constructed in a different and more simple form, or replaced entirely by a processor.

FIG. 6 shows an expanded system, in which two valve blocks I and II are used. Each of these two valve blocks can be constructed as illustrated in FIGS. 1 to 4 and 1*a* and 4*a* respectively.

The expanded system illustrated in FIG. 6 serves as a control system for a vehicle. The vehicle, not shown in detail, has a steering hand wheel 91 which is provided with two detectors 94, 95. One detector 94 is connected to a processing device 26. The other detector 95 is connected to another processing device 27. Both detectors 94, 95 are connected to the processing unit 83. The processing unit 26 controls the valve block I. The processing unit 27 controls the valve block II. For the sake of clarity, the individual line connections are replaced here by the arrows pointing to the numerals I and II.

Position detectors 96, 97 are arranged on the work motor 23, which corresponds to the work motor 4 of FIGS. 1 to 4. From these position sensors signal lines 104, 105 lead to the processing units 26 and 27 respectively, the two lines also being connected to the processing unit 83. Furthermore, a speed meter 92 is provided, which has two detectors 98, 99 which are connected by way of a signal, line 102, 103 respectively, to the processing unit 26, 27 respectively. Both detectors 98, 99 are connected to the processing unit 83.

As already mentioned, the system is constructed so that the processing unit 26 controls the valve block I, while the processing unit 27 controls the valve block II. The processing unit 83 is used for monitoring the input signals and, together with the comparator unit 28, a decision can be made as to which of the processing units 26, 27 is to be active. The inactive processing unit 26 does not then produce any output signals, with the result that the associated valve block I, II is automatically blocked. Control is then effected exclusively by way of the other valve block.

Control can be made speed-dependent by means of the speed meter 92.

The functions of the valve blocks I, II, with which operation with a clamped load is carried out, can be used in the control of vehicles to fix the steered wheels in a desired position. This is particularly advantageous when the valve blocks I, II are controlled so that the same pressure is present on both sides of the work cylinder 93. In this connection, with a negative loading a return flow to the tank is automatically blocked. External influences then have hardly any effect on the position of the steered wheels. This is a particular advantage in the case of unmanned vehicles which are being steered by means of a guiding line.

What is claimed is:

1. A hydraulic system having a pressure source, a pressure sink, a work motor, a main valve arranged between the pressure source and the pressure sink on the one hand and the work motor on the other hand and connected to the work motor by way of work connections, an input compensating valve located between the pressure source and main valve, and an additional outlet compensating valve located between the main valve and the pressure sink to control volume flow from the main valve to the pressure sink, in which at least one of the compensating valves is controlled by means of a load sensing signal deduced from a pressure in the work connections, the outlet compensating valve having a degree of opening controllable externally by a control arrangement, said control arrangement having at least one sensor for determining if load on the work motor is a positive or negative load, said control arrangement having means for controlling the load sensing signal for influencing the degree of opening of the outlet compensating valve depending on said positive or negative load.

2. A system according to claim 1, including means for adjusting the pressure of the load-sensing signal separately for each compensating valve.

3. A system according to claim 1, including at least in the outlet compensating valve, a counter-pressure acting oppositely to the pressure of the load-sensing signal, said counter-pressure being adjustable.

4. A system according to claim 2, in which the load-sensing signals for the two compensating valves are isolated from one another by a restrictor device having a separate restrictor for each load-sensing signal.

5. A system according to claim 3, including a control valve arrangement which lowers or raises the pressure of the load-sensing signal, or lowers the counter-pressure, said control valve arrangement being provided at least for one compensating valve.

6. A system according to claim 5, in which the control valve arrangement has a respective plus valve for increasing the pressure of the load-sensing signal, or for lowering the counter-pressure, and a minus valve for lowering the pressure of the load-sensing signal.

7. A system according to claim 6, in which the plus valve and the minus valve are in the form of controllable restrictors comprising pulse width modulated electromagnetic valves.

8. A system according to claim 6, including a priority shuttle valve arranged between an input connection and an output connection of the main valve, an output of said priority shuttle valve being connected by way of a restrictor to the counter-pressure input of the output compensating valve, the minus valve being arranged between the restrictor and the output compensating valve on the one hand and the pressure sink on the other hand.

9. A system according to claim 6, in which a respective compensating slide valve is arranged between the plus and minus valves connected to the pressure sink.

10. A system according to claim 1, in which the sensor has a loading sensor, which establishes which work chamber of the work motor is at a higher pressure and which detects the position of a valve member in a load-sensing shuttle valve connected between the two work connections, and has a position sensor, which detects the position of the main valve.

11. A system according to claim 1, in which each sensor has a pressure comparator in the form of a position sensor which detects the position of a valve member of a further shuttle valve, which is arranged between the input connection and the output connection of the main valve, which pressure comparator determines whether the pressure is higher in the input connection or in the output connection of the main valve.

12. A system according to claim 10, in which each sensor produces binary value output signals in electrical, pneumatic or hydraulic form in dependence on the position of its respective valve members.

13. A system according to claim 3, in which the output compensating valve is opened, when loading is positive, by means of the counter-pressure that acts by way of a pressure line, a further shuttle valve and a restrictor.

14. A system according to claim 1, in which a top-up valve is located between the main valve and the pressure sink.

15. A system according to claim 1, in which the output compensating valve closes when the loading is negative under the effect of the load-sensing signal and spring.

16. A system according to claim 1, in which, with negative loading, the control arrangement provides controlled lowering of the pressure of the load-sensing signal associated with the output compensating valve.

17. A system according to claim 1, including a change-over valve having a position dependent on whether loading is positive or negative, and which in one position connects the load-sensing signal to the input compensating valve and the minus valve associated with it, and in another position connects the input compensating valve to the pressure sink and the minus valve to the output compensating valve and the load-sensing signal.

18. A system according to claim 17, in which the change-over valve is hydraulically activatable and switches over when the loading changes from positive to negative or vice versa.

19. A system according to claim 18, in which the hydraulically activatable change-over valve has two work chambers which are connected to the input connection and output connection respectively, the hydraulically activatable change-over valve and the further shuttle valve being joined with common work chambers.

20. A system according to claim 1, in which the main valve comprises a direction-determining proportional valve, wherein to change the volume flow, the control arrangement carries out an approximate control of the volume flow by means of the compensating valves and a more precise regulation by means of the main valve.

21. A system according to claim 1, in which the main valve comprises a shuttle valve of constant area and with a neutral position.

22. A system according to claim 1, in which the main valve comprises a bridge circuit of positively controlled valves.

23. A system according to claim 22, in which valves of the bridge circuit comprise positively controlled ball shuttle valves.

24. A system according to claim 23, including an auxiliary fluid source which acts by way of control valves on control inputs of the valves of the bridge circuit.

25. A system according to claim 1, in which the control arrangement has a comparator unit for detecting at least one error state, the control arrangement switching all valves to no-load when an error state occurs.

26. A system according to claim 25, in which electromagnetic valves interrupt the volume flow through the input compensating valve and the output compensating valve in the absence of control signals.

27. A system according to claim 25, in which the control arrangement contains at least two processing units working in parallel which receive the same input signals, and a comparator unit which compares output signals of the processing units and registers an error state in the event of anomalies in said output signals.

28. A system according to claim 27, including at least three processing units, and the comparator unit produces an auxiliary error signal when just one processing unit produces an output signal differing from output signals of the other processing units, and when there is an auxiliary error signal the comparator unit identifies the processing unit producing the differing output signal and disables this processing unit.

29. A system according to claim 1, in which the work motor is a steering motor of a vehicle steering system.

30. A system according to claim 1, in which the system is constructed with a redundancy factor from at least two valve sections which are controlled by independent electronic processing units, the valve sections being connected in parallel and supplying the same work cylinder.

* * * * *